US007364277B2

(12) United States Patent
Chwalek et al.

(10) Patent No.: US 7,364,277 B2
(45) Date of Patent: Apr. 29, 2008

(54) APPARATUS AND METHOD OF CONTROLLING DROPLET TRAJECTORY

(75) Inventors: James M. Chwalek, Pittsford, NY (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 274 days.

(21) Appl. No.: 10/824,507

(22) Filed: Apr. 14, 2004

(65) Prior Publication Data

US 2005/0231558 A1 Oct. 20, 2005

(51) Int. Cl.
*B41J 2/09* (2006.01)

(52) U.S. Cl. ..... 347/77; 347/54; 347/75

(58) Field of Classification Search ..... 347/54, 347/75, 77

See application file for complete search history.

(56) References Cited

U.S. PATENT DOCUMENTS

| | | | | |
|---|---|---|---|---|
| 1,941,001 | A | 12/1933 | Hansell | |
| 3,373,437 | A | 3/1968 | Sweet et al. | |
| 3,709,432 | A | 1/1973 | Robertson | |
| 4,275,401 | A | 6/1981 | Burnett et al. | |
| 4,347,521 | A | 8/1982 | Teumer | |
| 4,384,296 | A | 5/1983 | Torpey | |
| 4,914,522 | A | 4/1990 | Duffield et al. | |
| 4,956,648 | A | 9/1990 | Hongo | |
| 5,224,843 | A | 7/1993 | van Lintel | |
| 6,079,821 | A | 6/2000 | Chwalek et al. | |
| 6,213,595 | B1 | 4/2001 | Anagnostopoulos et al. | |
| 6,217,163 | B1 | 4/2001 | Anagnostopoulos et al. | |
| 6,367,909 | B1 | 4/2002 | Lean | |
| 6,457,797 | B1 | 10/2002 | Van Der Meijs et al. | |
| 6,491,362 | B1 | 12/2002 | Jeanmaire | |
| 6,508,543 | B2 | 1/2003 | Hawkins et al. | |
| 6,517,197 | B2 * | 2/2003 | Hawkins et al. | 347/74 |
| 6,527,357 | B2 | 3/2003 | Sharma et al. | |
| 6,536,873 | B1 | 3/2003 | Lee et al. | |
| 6,561,616 | B1 * | 5/2003 | Hawkins et al. | 347/20 |
| 6,572,222 | B2 * | 6/2003 | Hawkins et al. | 347/77 |
| 6,588,888 | B2 | 7/2003 | Jeanmaire et al. | |
| 6,827,429 | B2 * | 12/2004 | Jeanmaire et al. | 347/77 |
| 6,883,904 | B2 * | 4/2005 | Jeanmaire et al. | 347/82 |
| 2001/0045973 | A1 * | 11/2001 | Sharma et al. | 347/54 |
| 2002/0093547 | A1 * | 7/2002 | Dante et al. | 347/48 |
| 2003/0081064 | A1 | 5/2003 | Dante et al. | |
| 2003/0112302 | A1 | 6/2003 | Furlani et al. | |
| 2003/0174190 | A1 | 9/2003 | Jeanmarie | |

FOREIGN PATENT DOCUMENTS

| | | | |
|---|---|---|---|
| EP | 0354706 | | 2/1990 |
| EP | 1201435 | A2 * | 5/2002 |
| EP | 1 219 425 | | 7/2002 |
| EP | 1354704 | | 10/2003 |
| JP | 61032762 | | 2/1986 |
| JP | 2002-240287 | | 8/2002 |

* cited by examiner

*Primary Examiner*—Manish S. Shah
*Assistant Examiner*—L E Martin
(74) *Attorney, Agent, or Firm*—William R. Zimmerli

(57) ABSTRACT

A printhead has a fluid chamber having an orifice, an associated fluid drop forming mechanism, and an associated fluid drop steering device. The fluid drop forming mechanism is operable to apply to fluid present in the fluid chamber energy sufficient to cause a fluid drop to be ejected from the orifice. The fluid drop steering device is operable to optionally apply to fluid present in the fluid chamber energy insufficient to cause drop formation prior to the fluid being ejected from the orifice. The fluid drop steering device is distinct from the fluid drop forming mechanism.

27 Claims, 20 Drawing Sheets

APPARATUS AND METHOD OF CONTROLLING DROPLET TRAJECTORY

FIELD OF THE INVENTION

The present invention relates, generally, to liquid droplet ejection, for example, inkjet printing, and, more particularly, to a method and apparatus for controlling the trajectory of ejected droplets.

BACKGROUND OF THE INVENTION

Ink jet printing, as one type of liquid droplet ejection, has become recognized as a prominent contender in the digitally controlled, electronic printing arena for advantages such as its non-impact, low-noise characteristics, its use of plain paper and its avoidance of toner transfers and fixing. Ink jet printing mechanisms can be generally categorized by technology, as either drop on demand ink jet or continuous ink jet devices.

The first technology, drop-on-demand ink jet printing, typically provides ink droplets for impact upon a recording surface using a pressurization actuator (thermal, piezoelectric, etc.). Selective activation of the actuator causes the formation and ejection of an ink droplet that crosses the space between the print head and the print media and strikes the print media. The formation of printed images is achieved by controlling the individual formation of ink droplets, as is required to create the desired image. With thermal actuators, a heater, located at a convenient location, heats the ink causing a quantity of ink to change phase, forming a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

Piezoelectric actuators, such as that disclosed in U.S. Pat. No. 5,224,843, issued to van Lintel, on Jul. 6, 1993, have a piezoelectric crystal in an ink fluid channel that flexes when an electric current flows through it, forcing an ink droplet out of a nozzle. The most commonly produced piezoelectric materials are ceramics, such as lead zirconate titanate, barium titanate, lead titanate, and lead metaniobate.

In U.S. Pat. No. 4,914,522, issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print medium.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This early technique is known as binary deflection continuous ink jet.

Later developments for continuous flow ink jet improved both the method of drop formation and methods for drop deflection. For example, U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher.

U.S. Pat. No. 6,588,888, issued to Jeanmaire et al. on Jul. 8, 2003, discloses a continuous ink jet printer capable of forming droplets of different size and having a droplet deflector system for providing a variable droplet deflection for printing and non-printing droplets.

One well known problem with any type of inkjet printer, whether drop-on-demand or continuous flow, relates to precision of dot positioning. In a printhead with an array of tiny ink nozzles, individual nozzles can differ slightly in fabrication and performance. Slight nozzle differences within tolerance may, for example, affect the trajectory direction of droplets ejected from a printhead, either in the direction in which the print head is scanned (typically referred to as the fast scan direction) or in the direction in which the receiving medium is periodically stepped (typically referred to as the slow scan direction, usually orthogonal to the fast scan direction). Slight errors in trajectory result in corresponding placement errors for printed drops. Another possible error source for dot placement is response time, where each nozzle does not emit its droplet of printing ink with precisely the same timing. This can cause displacement errors in the scan direction. As a result of such fabrication differences and timing response, dot positioning on the print medium may vary slightly, pixel to pixel. For the most part, these minor differences result in placement errors no larger than some fraction of a pixel dimension. For example, where pixels may be placed 30 microns apart, center-to-center, typical errors in dot placement are on the order of 2 microns or larger.

Under some conditions, small placement errors within this sub-pixel range of dimensions may be imperceptible in an output print. However, as is well known in the imaging arts, undesirable banding effects can be the result of a recurring pixel positioning error due to the printhead or its support mechanism. Such banding is typically most noticeable in areas of text or areas of generally uniform color, for example, and can severely compromise the image quality of output prints. One solution used to compensate for banding effects is the use of multiple banding passes, repeated over the same area of the printed medium. This enables a printhead to correct for known banding errors, but requires a more complex printing pattern, requires a more complex and accurate medium transport mechanism, and takes considerably more time per print. Under worst-case conditions, correction for band effects can result in significant loss of productivity, even as high as 10× by some estimates.

Typically, users of inkjet printers are forced to accept a level of relative inaccuracy in dot placement. It can readily be appreciated that it would be desirable to correct slight droplet placement errors by controlling the operation of individual nozzles of a print head, thus obviating the need for multiple banding passes. Proposed solutions for adjusting dot placement with ink jet printing apparatus of various types include the following:

- U.S. Pat. No. 6,457,797 (Van Der Meijs et al.) discloses using timing changes to offset the effects of print head temperature changes on relative dot placement for a complete nozzle array in a drop-on-demand type ink jet printer;
- U.S. Pat. No. 4,956,648 (Hongo) also discloses manipulating timing intervals for correcting slow and fast scan dot placement in a drop-on-demand type ink jet printer, segmenting the unit dot pitch time interval into suitable sub-intervals;
- U.S. Pat. No. 6,536,873 (Lee et al.) discloses bidirectional droplet placement control in a drop-on-demand type ink jet printer, using heater elements to alter the shape of an ink meniscus after the ink is expelled from a nozzle;
- U.S. Pat. No. 4,347,521 (Teumer) discloses a print head employing a complex set of electrodes for droplet deflection in a continuous ink jet apparatus;
- U.S. Pat. No. 4,384,296 (Torpey) similarly discloses a continuous ink jet print head having a complex arrangement of electrodes about each individual print nozzle for providing multiple print droplets from each individual ink jet nozzle;
- U.S. Pat. No. 6,367,909 (Lean) discloses a continuous ink jet printing apparatus employing an arrangement of counter electrodes within a printing drum for correcting drop placement;
- U.S. Pat. No. 6,517,197 (Hawkins et al.) discloses an apparatus and method for corrective drop steering in the slow scan direction for a continuous ink jet apparatus using a slow-scan droplet steering mechanism that employs a split heater element;
- U.S. Pat. No. 6,491,362 (Jeanmaire) discloses an apparatus and method for varying print drop size in a continuous ink jet printer to allow a variable amount of droplet deflection in the fast scan direction with multiple droplets per pixel;
- U.S. Pat. No. 6,217,163 (Anagnostopoulos et al.) discloses a continuous ink jet apparatus and method that provides ink filament steering using a segmented heater to compensate for drop placement inaccuracy;
- U.S. Pat. No. 6,213,595 (Anagnostopoulos et al.) discloses a continuous ink jet apparatus and method that provides ink filament steering at an angle offset from normal using power-adjustable segmented heaters;
- U.S. Pat. No. 6,508,543 (Hawkins et al.) discloses a continuous ink jet print head capable of displacing printing droplets at a slight angular displacement relative to the length of the nozzle array, using a positive or negative air pressure;
- U.S. Pat. No. 6,572,222 (Hawkins et al.) similarly discloses use of variable air pressure for deflecting groups of droplets to correct placement in the fast scan direction;
- U.S. Patent Application Ser. No. 2003/0174190 (Jeanmaire) discloses improved measurement and fast scan correction for a continuous ink jet printer using air flow and variable droplet volume; and,
- U.S. Pat. No. 4,275,401 (Burnett et al.) discloses deflection of continuous ink jet print droplets in either the fast or slow scan direction using an arrangement of charging electrodes.

As the above listing shows, there have been numerous proposed solutions for adjusting print droplet trajectory in both drop-on-demand and continuous inkjet printing apparatus. In general, these solutions include approaches such as altering the timing of dot formation or providing a steering mechanism that is external to the fluid chamber from which droplets are ejected, or applying gas pressure, heat, or electrostatic charge to ejected fluid, for example. While each of these solutions may provide suitable steering performance, there is room for improvement, particularly for drop-on-demand print heads. There are inherent difficulties in controlling fluid meniscus formation with drop-on-demand devices and, related to these difficulties, some degree of inherent inaccuracy in droplet steering. In particular, it can be appreciated that there would be advantages to a droplet steering solution that is internal to the fluid chamber of the ejecting mechanism itself. This type of solution could be produced at a favorable cost and enjoy improved robustness, because it would not require an external steering mechanism that must be properly aligned for cooperation with each individual ejecting nozzle.

One approach using droplet steering internal to the fluid chamber is disclosed in Japanese Patent Abstract Publication 2002-240287 by Eguchi Takeo et al. The Takeo et al. publication discloses a drop-on-demand printhead nozzle equipped with a plurality of heaters, wherein one or more heaters is energized for ejecting a liquid drop with a desired trajectory. In the Takeo et al. device, any one of the internal heaters is individually capable of providing sufficient threshold energy for fluid droplet formation. Droplet steering is then effected by asymetrically modulating the energy supplied by one or more heaters. While this solution may provide some measure of droplet trajectory modulation, the Takeo et al. apparatus energizes the same heaters for both droplet formation and droplet steering. Due to inherent instability in the process of forming and releasing a droplet at each nozzle, fine-tuning, by which an individual droplet trajectory can be corrected to within a few microns or less, can be difficult to achieve using such an approach.

Thus, it can be seen that there is a need for an improved apparatus and method for controlling the trajectory of ejected droplets with both drop-on-demand and continuous flow print heads.

SUMMARY OF THE INVENTION

According to one feature of the present invention, a printhead comprises a fluid chamber having an orifice. A fluid drop forming mechanism is associated with the fluid chamber and is operable to apply to fluid present in the fluid chamber energy sufficient to cause a fluid drop to be ejected from the orifice. A fluid drop steering device is associated with the fluid chamber and is operable to optionally apply to fluid present in the fluid chamber energy insufficient to cause drop formation prior to the fluid being ejected from the orifice. The fluid drop steering device is distinct from the fluid drop forming mechanism.

According to another feature of the present invention, a method of ejecting a fluid drop comprises providing a fluid having a drop formation energy threshold; optionally applying to the fluid an energy below the drop formation energy threshold; and forming a fluid drop by applying to the fluid an energy exceeding the drop formation energy threshold.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
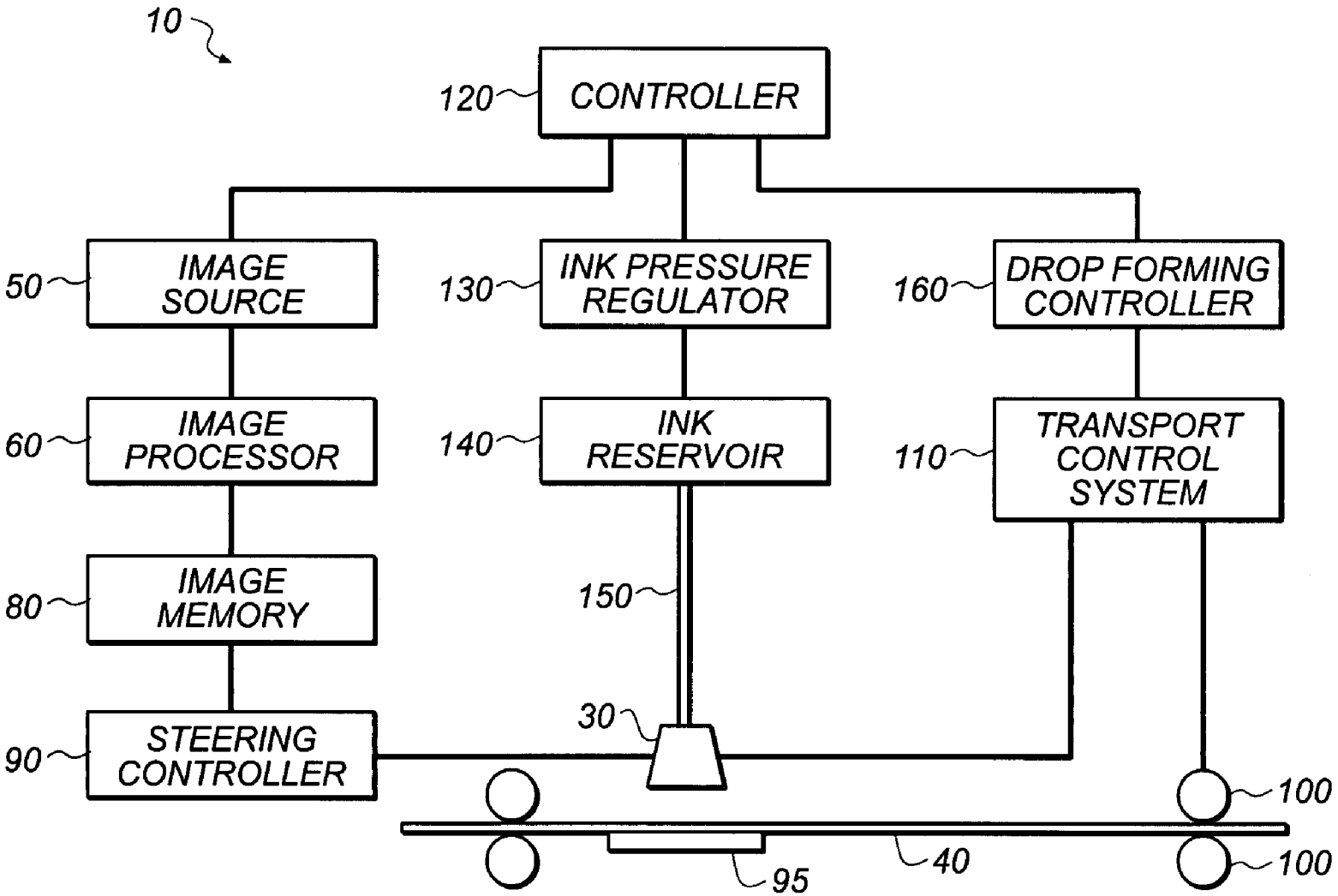
FIG. 1 is a view in perspective of an ink jet printer according to the present invention.

Referring to FIG. 1, there is shown an imaging apparatus 10 capable of controlling the trajectory of fluid droplets according to the present invention. Imaging apparatus 10 accepts image data from an image source 50 and processes this data for a print head 30 in an image processor 60. Image processor 60, typically a Raster Image Processor (RIP) or other type of processor, converts the image data to a pixel-mapped page image for printing. During printing operation, a receiver 40 is moved relative to print head 30 across a supporting platen 95 by means of a plurality of transport rollers 100, which are electronically controlled by a transport control system 110. A logic controller 120 provides control signals for cooperation of transport control system 110 with an ink pressure regulator 130 and a drop forming controller 160. Drop-forming controller 160 provides the drive signals for ejecting individual ink droplets from print head 30 to receiver 40 according to the image data. A drop steering controller 90 cooperates with drop-forming controller 160, providing steering control signals to individual fluid chambers in print head 30, as described below, in response to drop steering correction information stored in image memory 80. Drop steering correction information can be generated from many sources, for example, from measurements of the steering errors of each nozzle in printhead 30, as is well known to one skilled in the art of printhead characterization and image processing. While image correction information may depend only on printhead characteristics in some cases, it may also depend on the image itself or on a combination of the image and the printhead characteristics, or may depend on the characteristics of the mechanical printer mechanism, as is well known in the art of image processing.

Ink pressure regulator 130, if present, regulates pressure in an ink reservoir 140 that is connected to print head 30 by means of a conduit 150. It may be appreciated that different mechanical configurations for receiver transport control may be used. For example, in the case of page-width print heads, it is convenient to move receiver 40 past a stationary print head 30. On the other hand, in the case of scanning-type printing systems, it is more convenient to move print head 30 along one axis (i.e., a sub-scanning direction) and receiver 40 along an orthogonal axis (i.e., a main scanning direction), in relative raster motion.

Figure 2A:
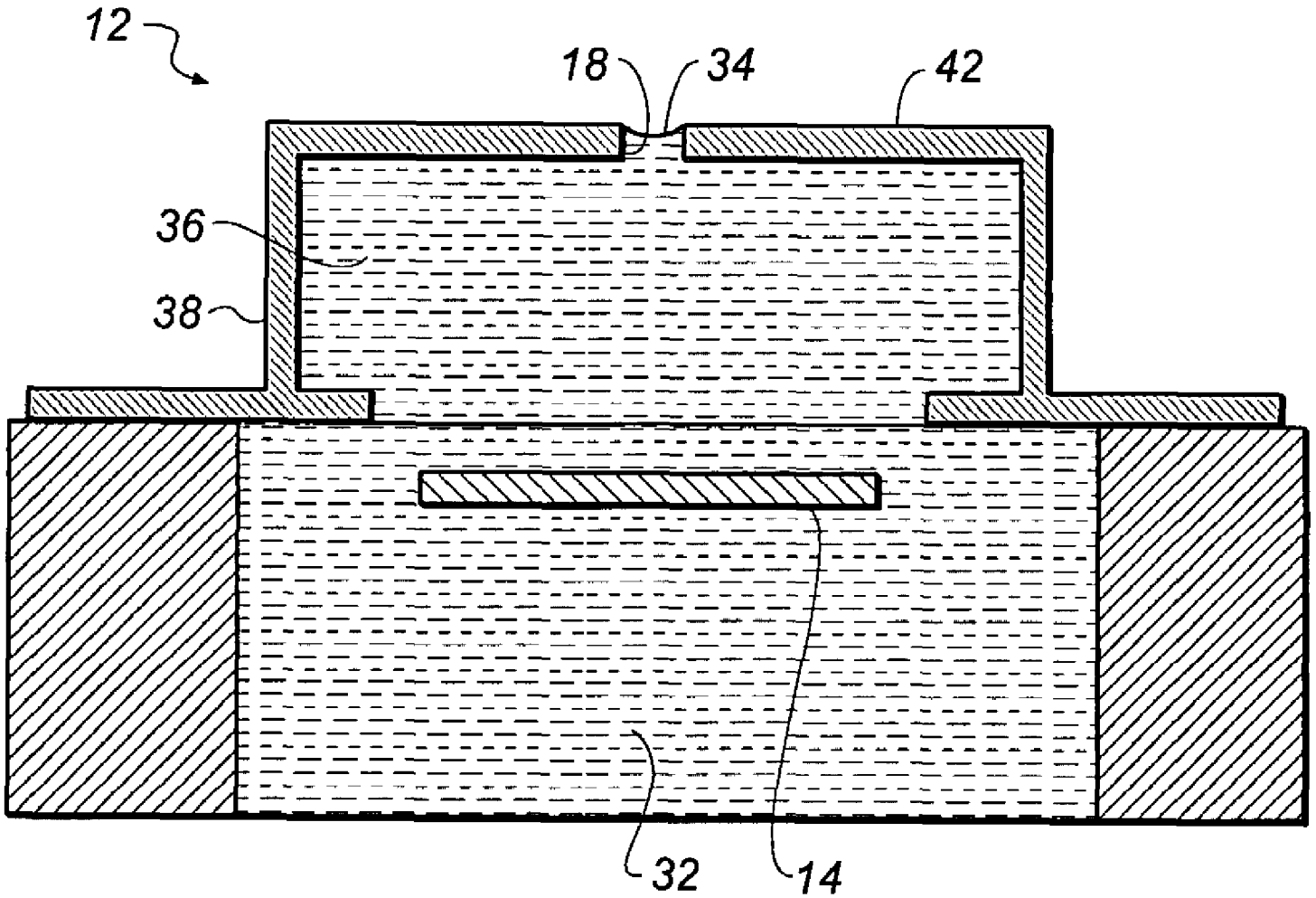
FIG. 2a (PRIOR ART)
FIGS. 2*a* and 2*b* are side views in cross section of a prior art print head nozzle in operation.
Figure 2B:
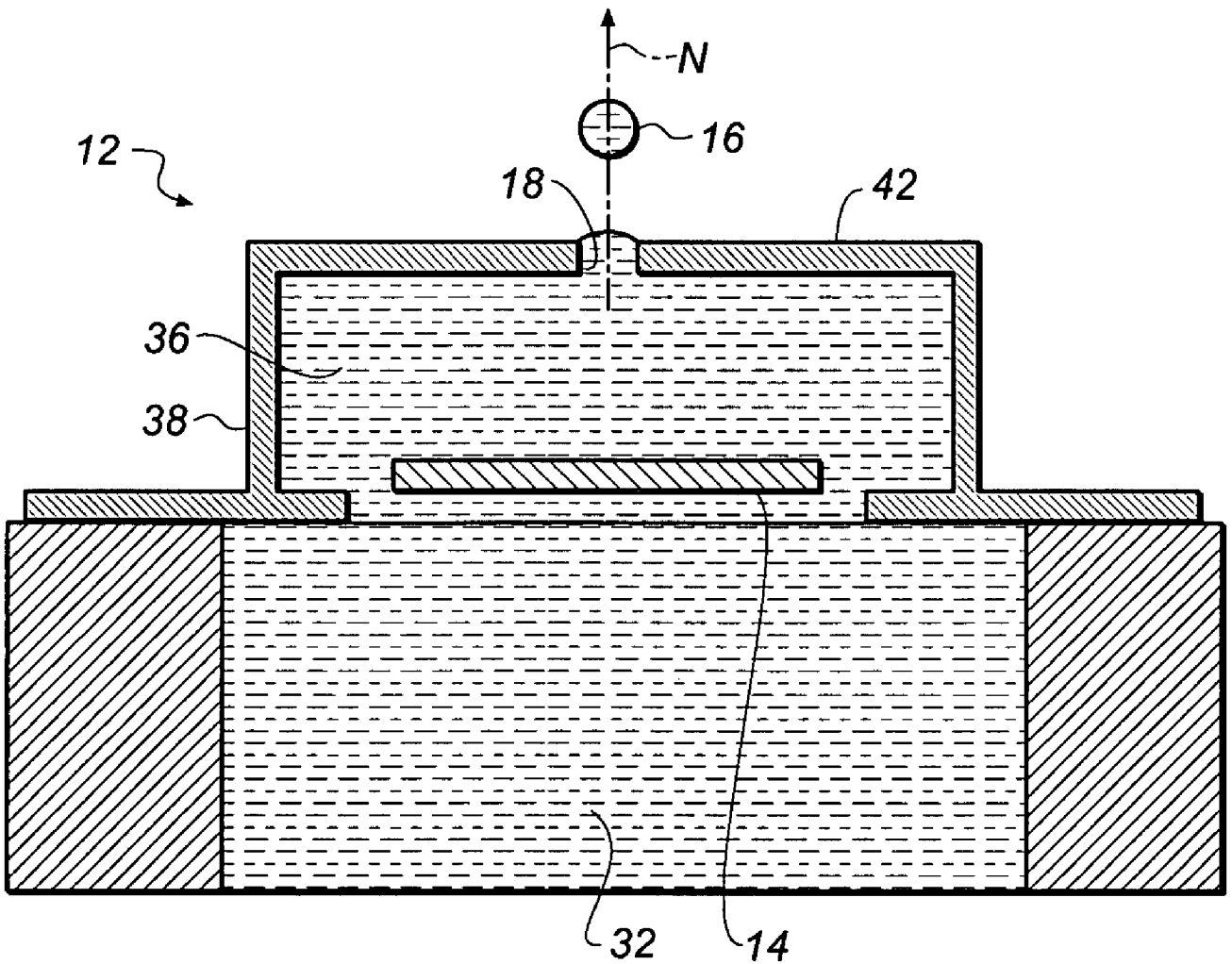
FIG. 2b (PRIOR ART)
Figure 2C:
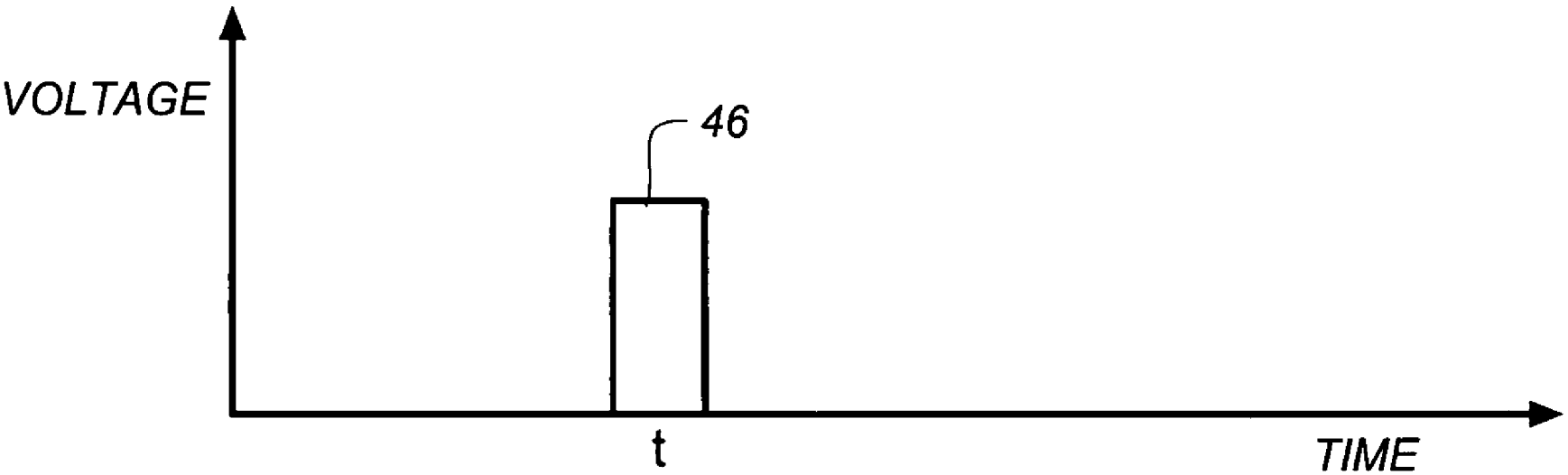
FIG. 2*c* is a graph showing the timing of an actuation signal as provided for the nozzle shown in FIGS. 2*a* and 2*b;*

Referring to FIGS. 2*a* and 2*b*, there is shown, in cross section, a nozzle 12 with a fluid chamber 36 for a conventional drop-on-demand print head 30. A movable piston operates as an actuator 14 for ejecting a fluid droplet 16 from an orifice 18 in a nozzle plate 42 of a chamber wall 38 that defines fluid chamber 36. Such a movable piston, also called a paddle, operable to eject fluid drops from a chamber is disclosed, for example, by Lebens in U.S. Pat. No. 6,598,960. At a rest position, as represented in FIG. 2*a*, actuator 14 is positioned within a fluid reservoir 32. The fluid forms a meniscus 34 at orifice 18. When actuated, as represented in FIG. 2*b*, actuator 14 forces ejection of fluid droplet 16 from fluid chamber 36. Fluid droplet 16 is ejected along a normal axis N to nozzle plate 42. The graph of FIG. 2*c* shows the timing relationship of drive voltage to actuator 14 for effecting the movement shown in FIG. 2*b* during an ejection pulse 46 for a time t.

Actuator 14 provides a fluid drop forming mechanism controlled by drop forming controller 160. Types of fluid drop forming mechanisms that could be used may employ piston type actuators, heaters, flexible membranes, electromagnetic actuators, piezoelectric actuators, or acoustical actuators, for example.

Figure 3A:
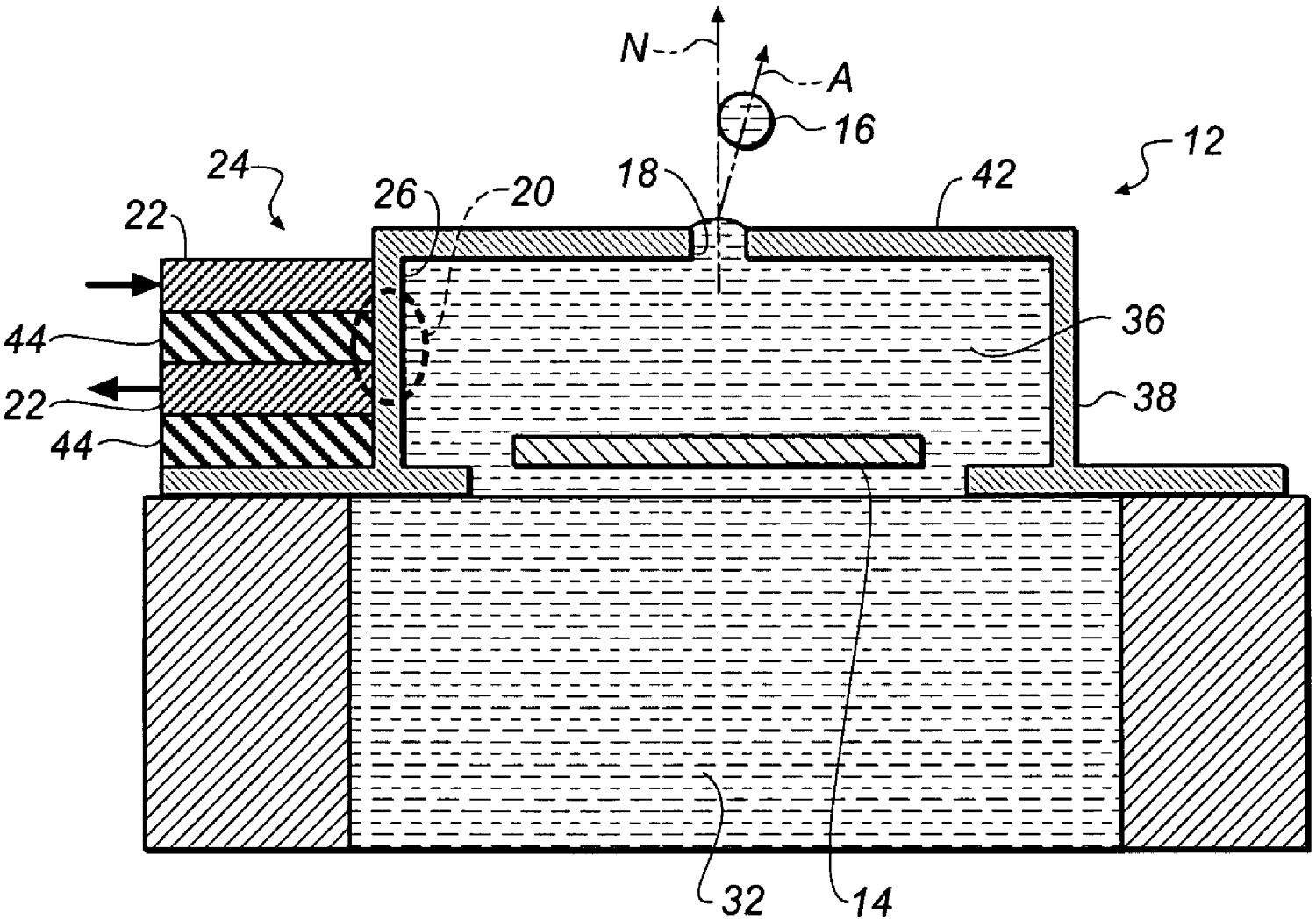
FIG. 3*a* is a side view in cross section of a print head nozzle having an integral heating component along the fluid chamber with external contacts for fluid drop steering in one embodiment.
Figure 3B:
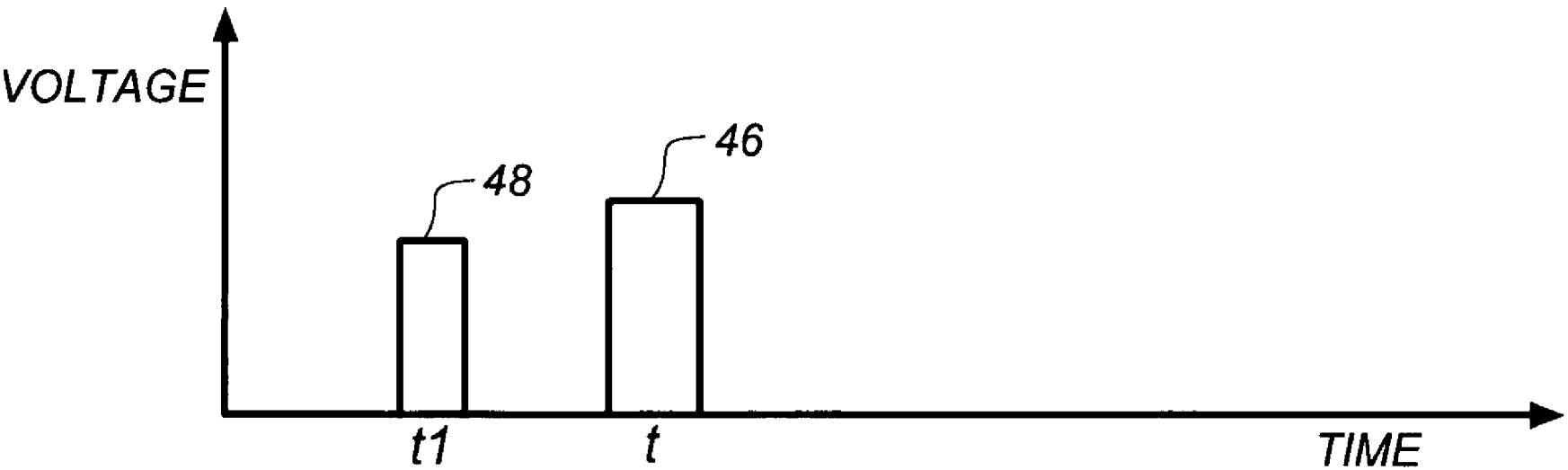
FIG. 3*b* is a graph showing the timing of an actuation signal as provided for the nozzle shown in FIG. 3*a;*

Referring to FIG. 3*a*, there is shown a cross-section view of nozzle 12 in one embodiment of the present invention, in which a fluid drop steering device 24 provides local perturbance of fluid in fluid chamber 36. In the embodiment of FIG. 3*a*, a heater 20 is formed as part of a conductive side wall 26 of fluid chamber 36. Electrical drive current for heater element 20 is conducted between electrodes 22 as controlled by drop steering control 90 (FIG. 1). Insulators 44 isolate electrodes 22 from other support components at nozzle 12. As shown by altered trajectory A in FIG. 3*a*, this added perturbance from fluid drop steering device 24 alters the standard path of fluid droplet 16 to an angle away from normal N, providing steering control for fluid droplet 16. The graph of FIG. 3*b* shows the relative timing relationship of drive voltage to fluid drop steering device 24 during a perturbation pulse 48 at a time t1 and to actuator 14 for effecting the movement shown in FIG. 3*a* during an ejection pulse 46 at a time t. In this embodiment, perturbation pulse 48 corresponds to the voltage provided to heater 20 from electrodes 22. Perturbation pulse 48 is represented as having a lower voltage level and shorter time duration than that of ejection pulse 46; however, this may or not be the case, depending on the type of fluid drop steering device 24 that is employed.

In the most general case, fluid drop steering device 24 is some mechanism for providing a local perturbance of fluid within fluid chamber 36, prior to or during ejection of fluid drop 16. In a preferred embodiment to the present invention, the perturbance alters the velocity of fluid flow during subsequent drop ejection, either because the perturbance itself produces a fluid flow which adds or subtracts from the flow produced by the drop ejection pulse, or because the perturbance modulates the pattern of fluid flow subsequently produced by the drop ejection pulse.

Heat energy, which raises the temperature of the fluid, is only one type of perturbing energy that may be applied by fluid drop steering device 24 to cause a corresponding shift in droplet 16 trajectories. Raising the temperature of the fluid generally changes the viscosity of the fluid, and although a viscosity change does not in itself cause flow in a stationary fluid, such a change later causes the velocity of fluid flow produced by the subsequent drop ejection pulse to be changed, in other words, the heat perturbance serves to modulate fluid flow subsequently induced during drop ejection. As shown by altered trajectory A in FIG. 3*a*, heat energy from fluid drop steering device 24 alters the path otherwise taken of fluid droplet 16 to an angle away from normal N, consistent with a reduction of fluid viscosity in the heated region 20 of the fluid. The amount of alteration of the trajectory (the angle between N and A in FIG. 3*a*) depends on the amount of heat delivered to the fluid and increases with that amount. Therefore, the amount of alteration of the trajectory can be controlled by changing the heater voltage, the duration of the heater pulse, or the separation in time between the perturbation pulse 48 and the ejection pulse 46, shown in FIG. 3*b*, as would be appreciated by one skilled in the art of electronic controls. In operation of the printer in accordance with the present invention, the amplitude, duration, and relative timing of perturbation pulse 48 and the ejection pulse 46 would be chosen and stored in memory 70 so that the amount of alteration of the trajectory was the desired amount for each drop of fluid ejected. The desired amount might be chosen based on the characteristics of the printhead and on various criteria of image quality, in the case of image printing, as would be understood by one skilled in image processing.

Figure 3C:
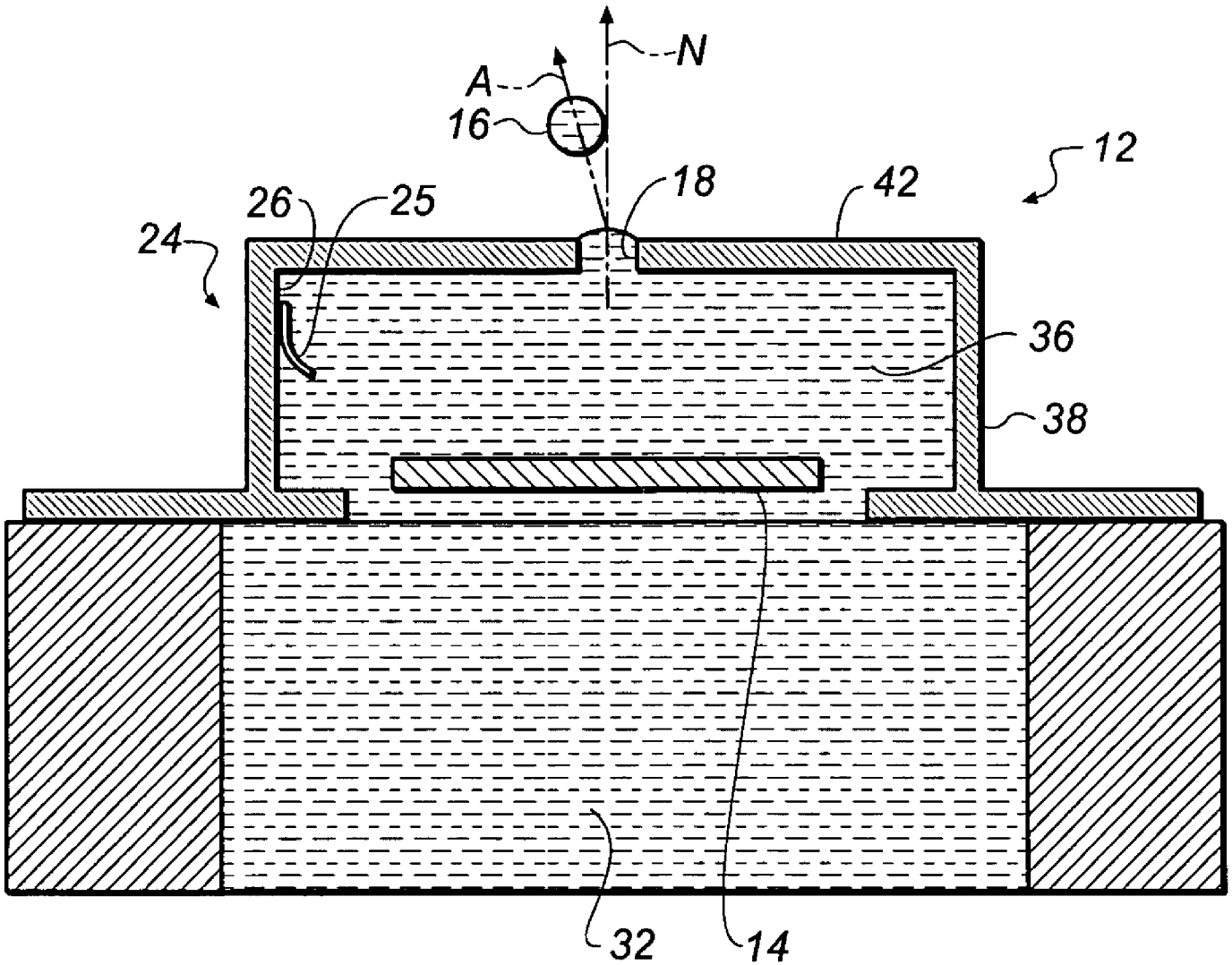
FIG. 3*c* is a side view in cross section of a print head nozzle having a mechanical actuator (shown in the bent or actuated position) as a fluid drop steering device.

Whereas most fluids experience reduced viscosity upon heating, this is not always the case. Pluronic additives, as used for example in injet drop ejectors disclosed by Sharma et. al. in U.S. Pat. No. 6,568,799, can be used to produce fluids whose viscosities increase with temperature. For fluids whose viscosity is reduced in response to heating, the heat energy from fluid drop steering device 24 would alter the path otherwise taken of fluid droplet 16 to an angle away from normal N in the direction opposite that shown in FIG. , 3*a*, that is to the left of N. Heating the fluid may also cause changes in surface tension, which can also alter fluid flow during subsequent drop ejection, as is well known in the art of fluid mechanics. Other types of perturbing energy suitable for fluid drop steering device 24 could be generated using a valve, paddle, or other mechanical component. Motion of a paddle itself produces a fluid flow, even in the absence of or prior to the flow produced by the ejection pulsed. Such flow adds to or subtracts from the flow produced by the subsequent ejection pulse to cause fluid drop steering. Changing a valve from an open to a closed state, may not in itself cause fluid to flow, however, it will alter the velocity of the fluid flow produced by the subsequent drop ejection pulse. FIG. 3*c* shows a fluid drop ejector with a paddle type mechanical actuator 25 located in fluid chamber 36. The mechanical actuator of paddle bends upon application of a voltage pulse through electrodes (not shown in FIG. 3*c*), as described, for example, in U.S. Pat. Nos. 6,644,786 and 6,685,303 issued to Lebens et. al. Mechanical actuator 25 is shown in a partially bent state in FIG. 3*c*. As can be appreciated by one skilled in the art of fluid dynamics and as discussed in U.S. Pat. Nos. 6,644,786 and 6,685,303, as the actuator is caused bend, fluid flow is set up in fluid chamber 36, which adds to the flow caused by ejection pulse 48, thereby cause a corresponding shift in droplet 16 trajectory. While the mechanical actuator disclosed by Lebens is sufficiently large that its motion alone can cause fluid drop ejection, the mechanical actuator of the present invention is smaller and cannot alone cause drops to be ejected. The actuator disclosed by Lebens can also be caused to assume a particular amount of bending in a rest state by the application of a voltage for a prolonged period of time, the amount of bending depending on the amplitude of the voltage. In this mode of operation in accordance with the present invention, the actuator does not cause fluid flow itself, being in a rest position, but the position of the actuator modulated the fluid flow in chamber 36 that arises from the subsequent ejection pulse, thereby causing a corresponding shift in droplet 16 trajectory.

It is significant to observe that perturbing energy from heater 20 or other type of fluid drop steering device 24 is not sufficient, of itself, for causing ejection of droplet 16 from orifice 18. That is, the perturbing energy is beneath the threshold energy level needed to cause droplet 16 ejection. Otherwise, high levels of perturbing energy, if sufficient to cause droplet 16 formation, would make it difficult to control the actual trajectory path of the ejected droplet 16. In FIG. 3*b*, this relationship is suggested in the relative duration and magnitudes of perturbation pulse 48 to ejection pulse 46. It is also instructive to note that perturbation pulse 48 and ejection pulse 46 may even overlap for some duration, such that both perturbing and drop-forming energy are provided to their separate mechanisms during this overlap period.

Figure 4A:
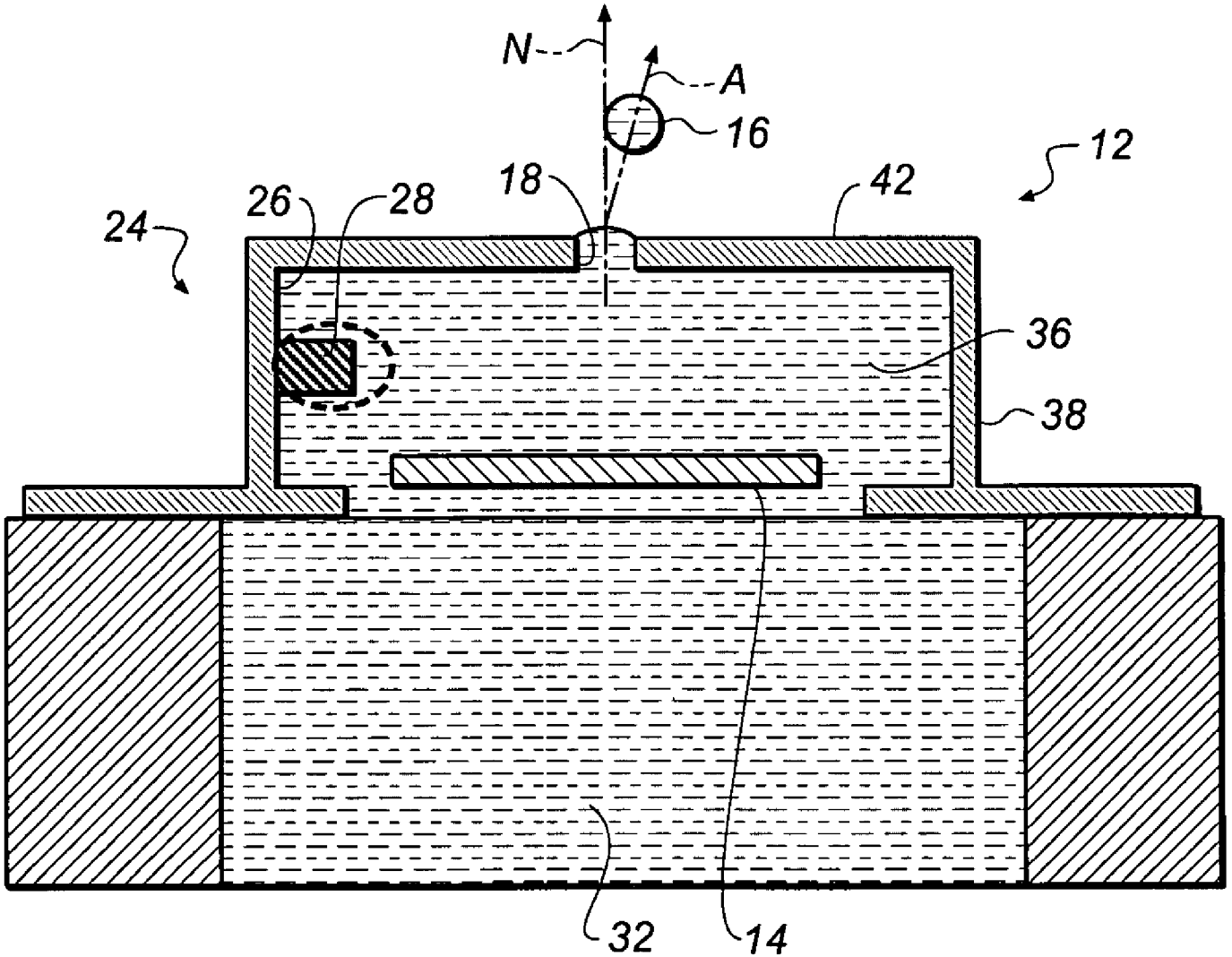
FIG. 4*a* is a side view in cross section of a print head nozzle having an integral heating component for fluid drop steering within the fluid chamber in an alternate embodiment.
Figure 4B:
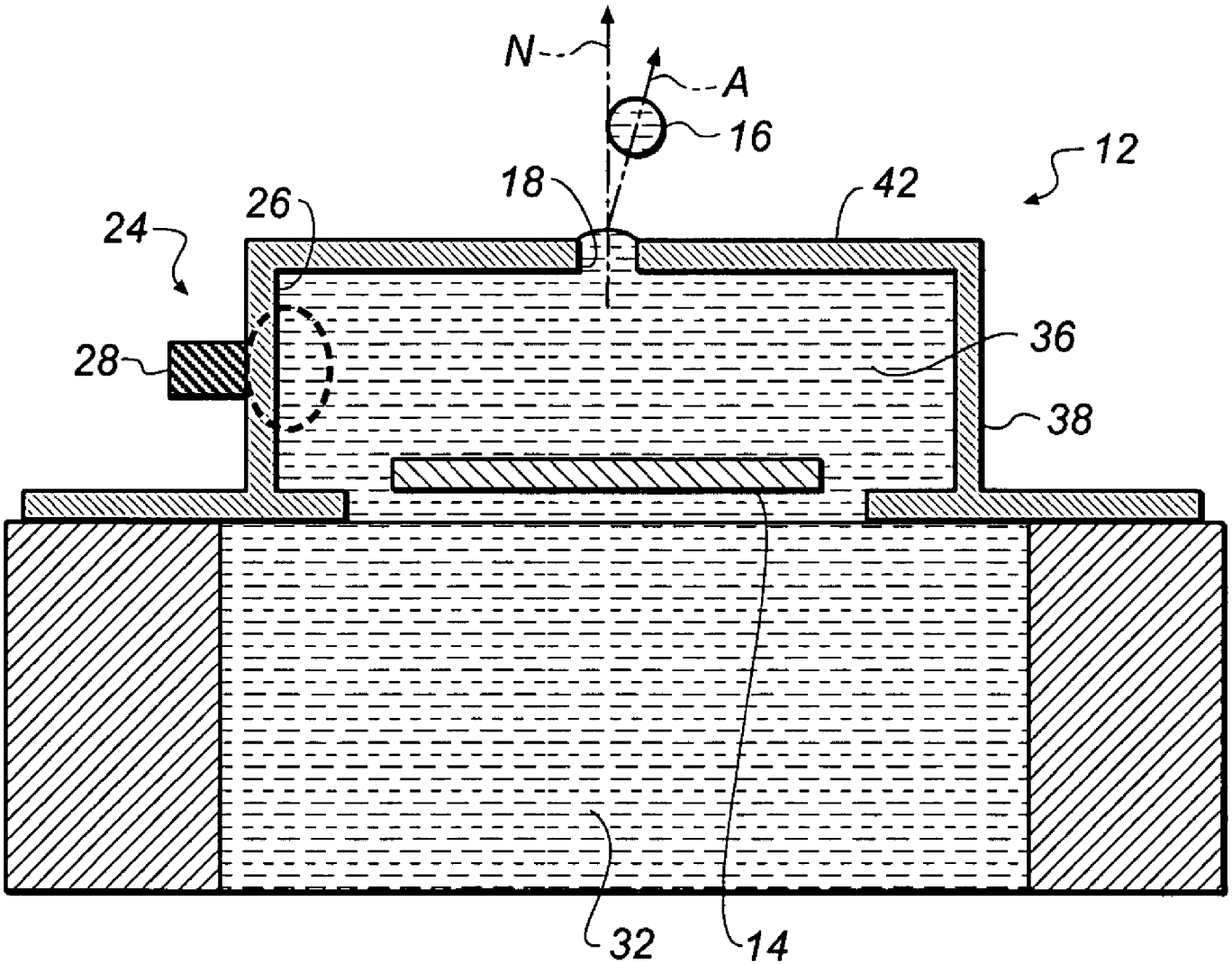
FIG. 4*b* is a side view in cross section of a print head nozzle having an integral heating component for fluid drop steering disposed outside of the fluid chamber in an alternate embodiment.
Figure 5:
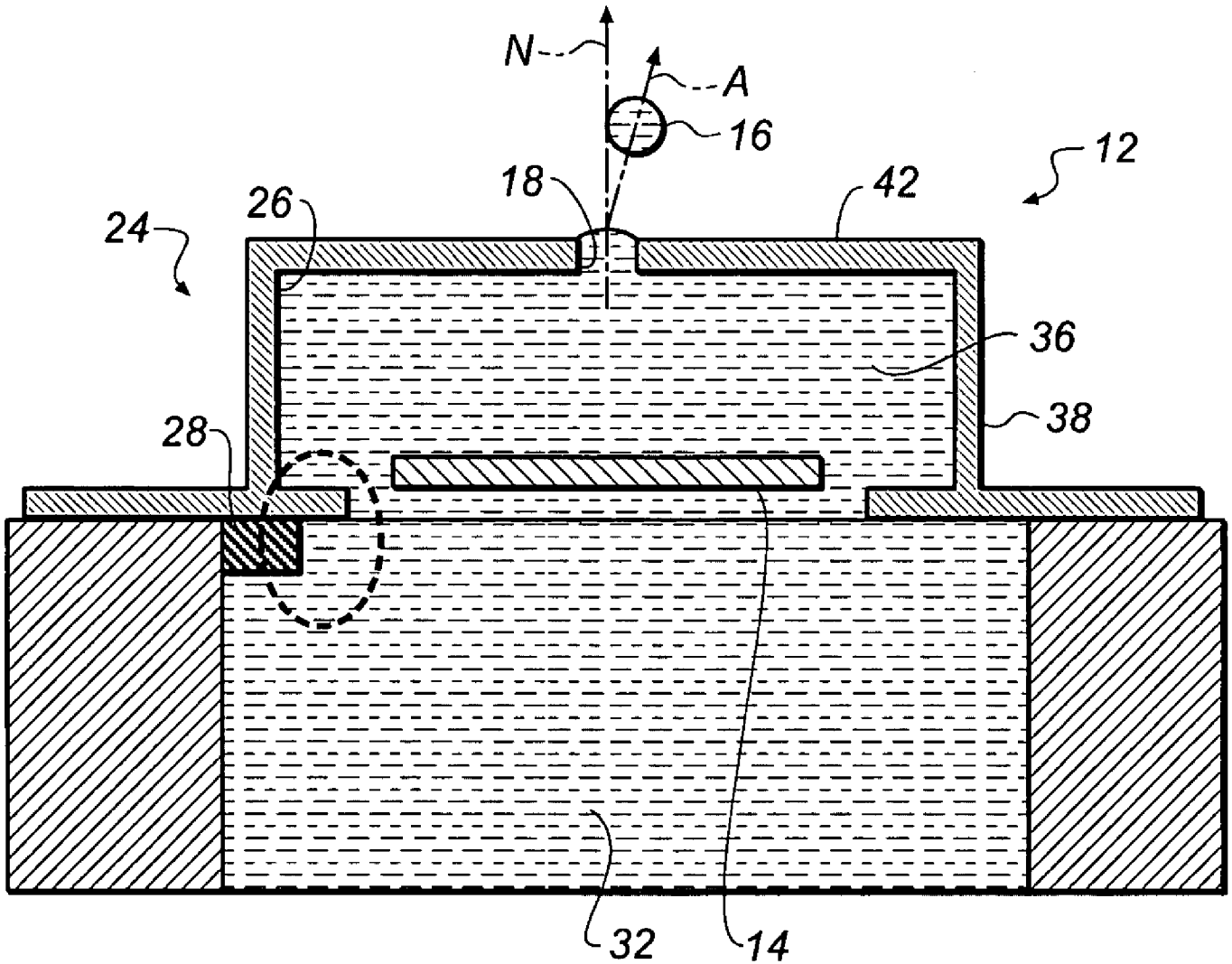
FIG. 5 is a side view in cross section of a print head nozzle having an integral heating component beneath the fluid chamber in an alternate embodiment.

In the embodiments of FIG. 4*a*-FIG. 9 that follow, a heater 28 is provided for providing perturbation energy as fluid drop steering device 24, with heater 28 disposed at some point within, or positioned against, fluid chamber 36. In FIG. 4*a*, for example, heater 28 is located within fluid chamber 36, along side wall 26. In FIG. 4*b*, heater 28 is mounted against side wall 26, outside of fluid chamber 36. In the embodiment of FIG. 5, heater 28 is located below fluid chamber 36, within fluid reservoir 32.

Referring to FIG. 4*a*, heater 28 is mounted within fluid chamber 36, along side wall 26. Heat asymmetrically applied by heater 28 within fluid chamber 36 causes ejection of fluid droplet 16 along trajectory A. FIG. 4*b* shows heater 28 mounted on side wall 26 outside of fluid chamber 36, producing the same overall effect on trajectory A as in FIG. 4*a*.

Referring to FIG. 5, heater 28 is positioned below the position of actuator 14 and below fluid chamber 36. As with FIGS. 4*a* and 4*b*, trajectory A depends both on characteristics of the fluid itself and on the amount of energy applied at heater 28.

Figure 6:
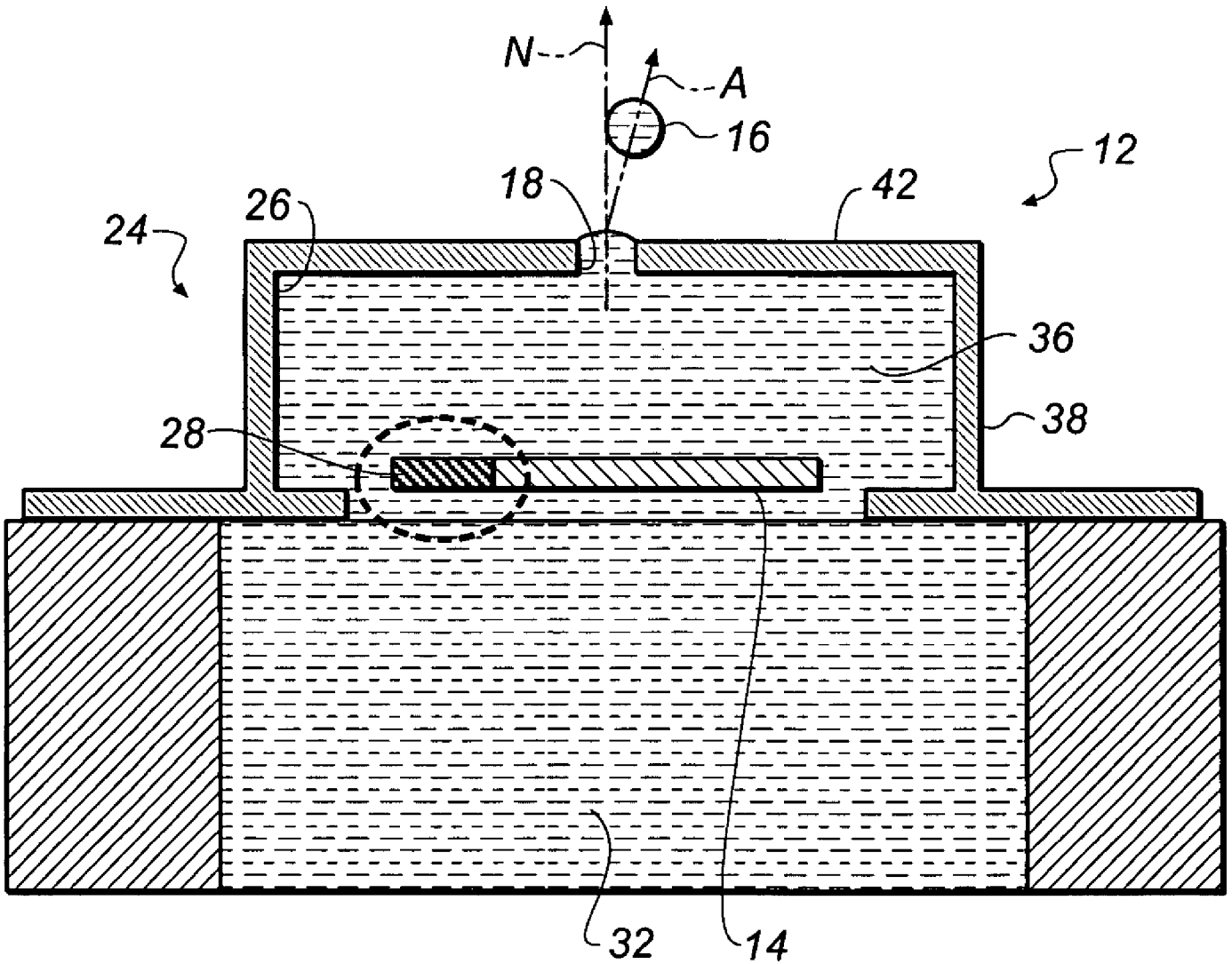
FIG. 6 is a side view in cross section of a print head nozzle having an integral heating component coupled to the fluid drop forming mechanism in an alternate embodiment.
Figure 7:
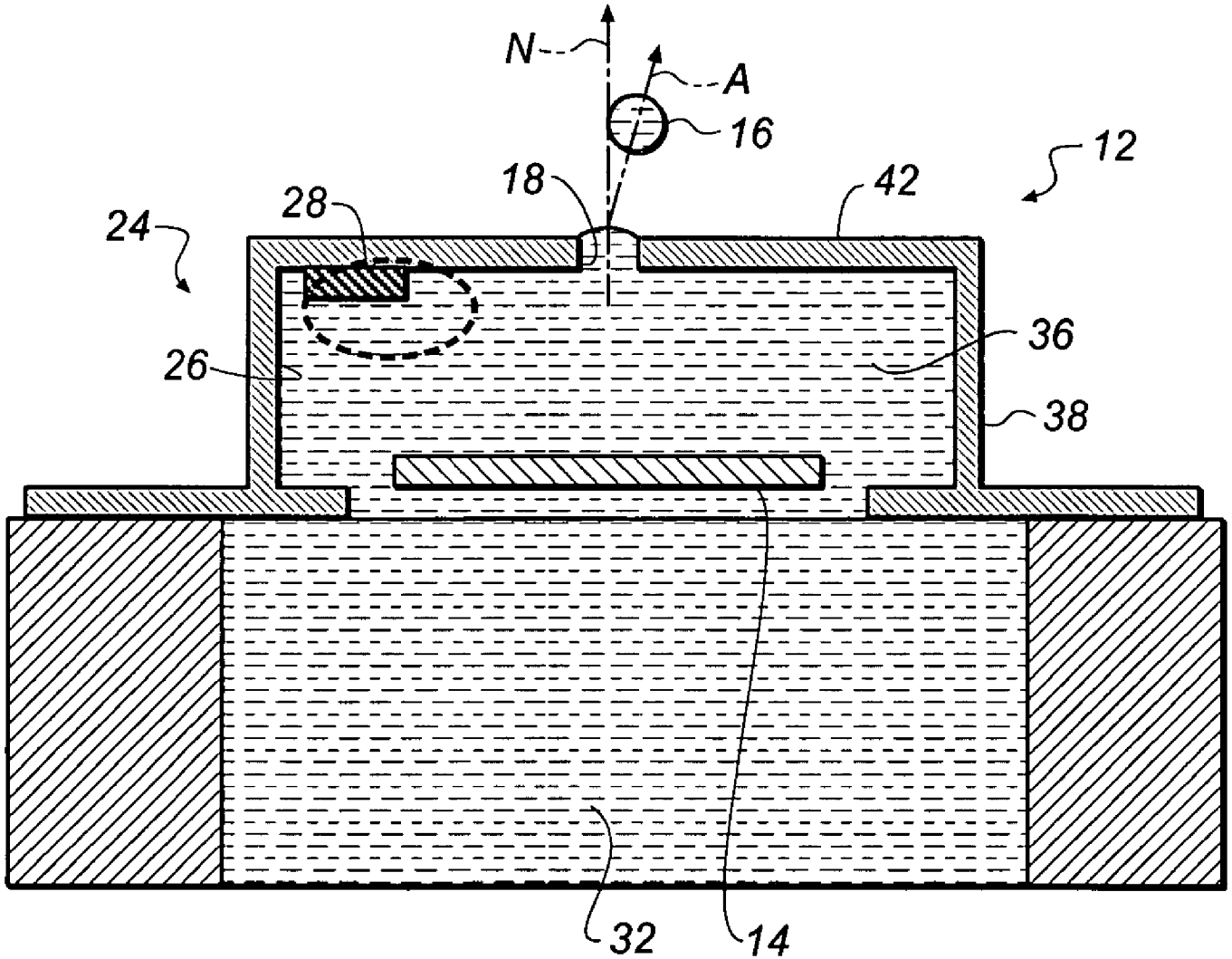
FIG. 7 is a side view in cross section of a print head nozzle having an integral heating component beneath the nozzle plate on one side of the fluid chamber in an alternate embodiment.

Referring to FIG. 6, heater 28 is coupled to a portion of the fluid drop forming mechanism of actuator 14. An asymmetric arrangement of nozzle 12 components, as represented in FIG. 6, provides angled orientation of altered trajectory A relative to nozzle 18. FIG. 7 shows yet another embodiment, with heater 28 located on the underside of nozzle plate 42.

Figure 8:
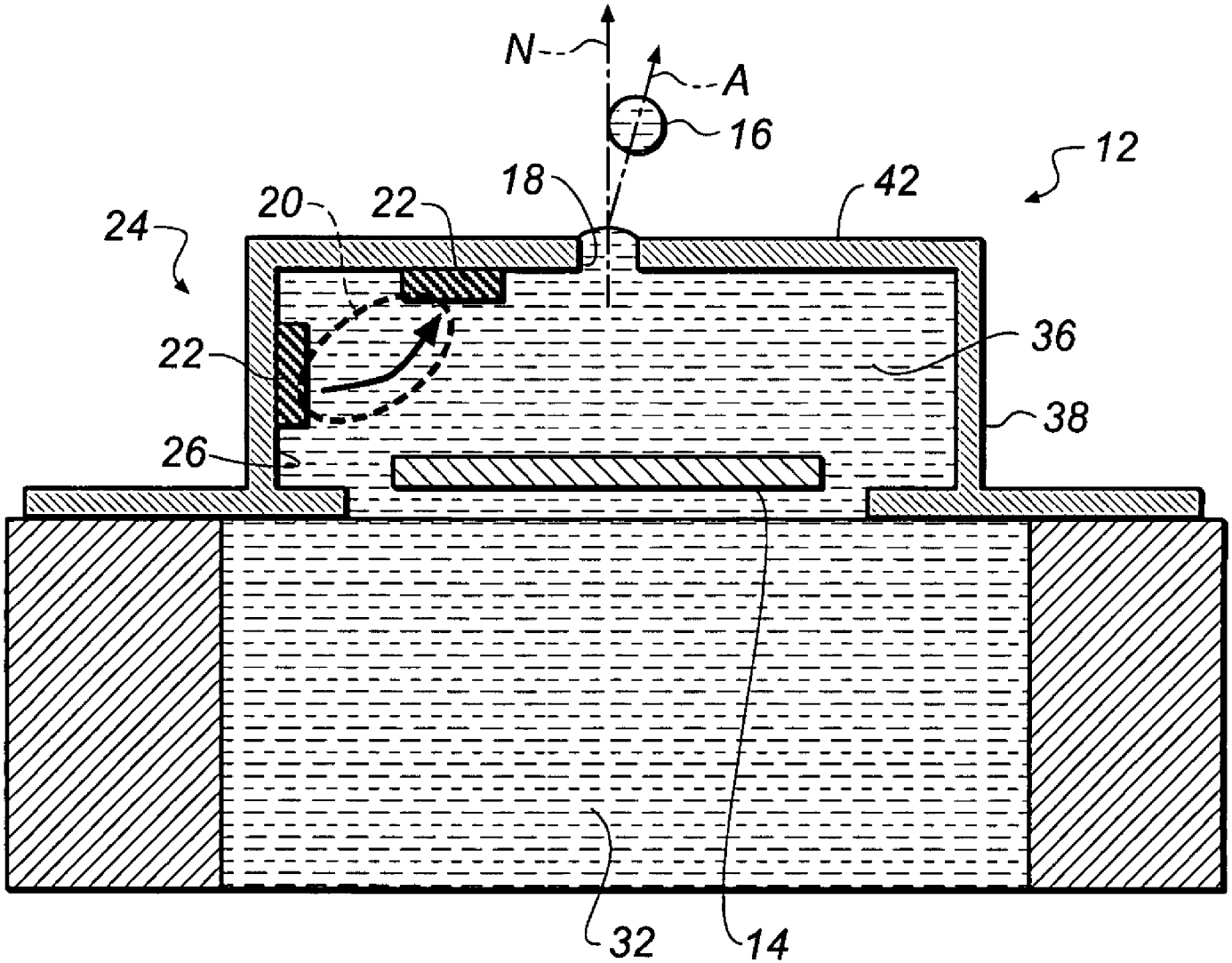
FIG. 8 is a side view in cross section of a print head nozzle having contacts for conducting current through the fluid to generate localized heat as a steering mechanism.

Referring to FIG. 8, there is shown yet another embodiment of the present invention in which internal electrodes 22 are provided for conducting current directly through a conductive fluid in fluid chamber 36. This arrangement effectively forms a heater 20 within fluid chamber 36 and takes advantage of conductive characteristics of specific inks or other fluids for providing a slight amount of heat perturbance for steering of droplets 16 along altered trajectory A.

Figure 9A:
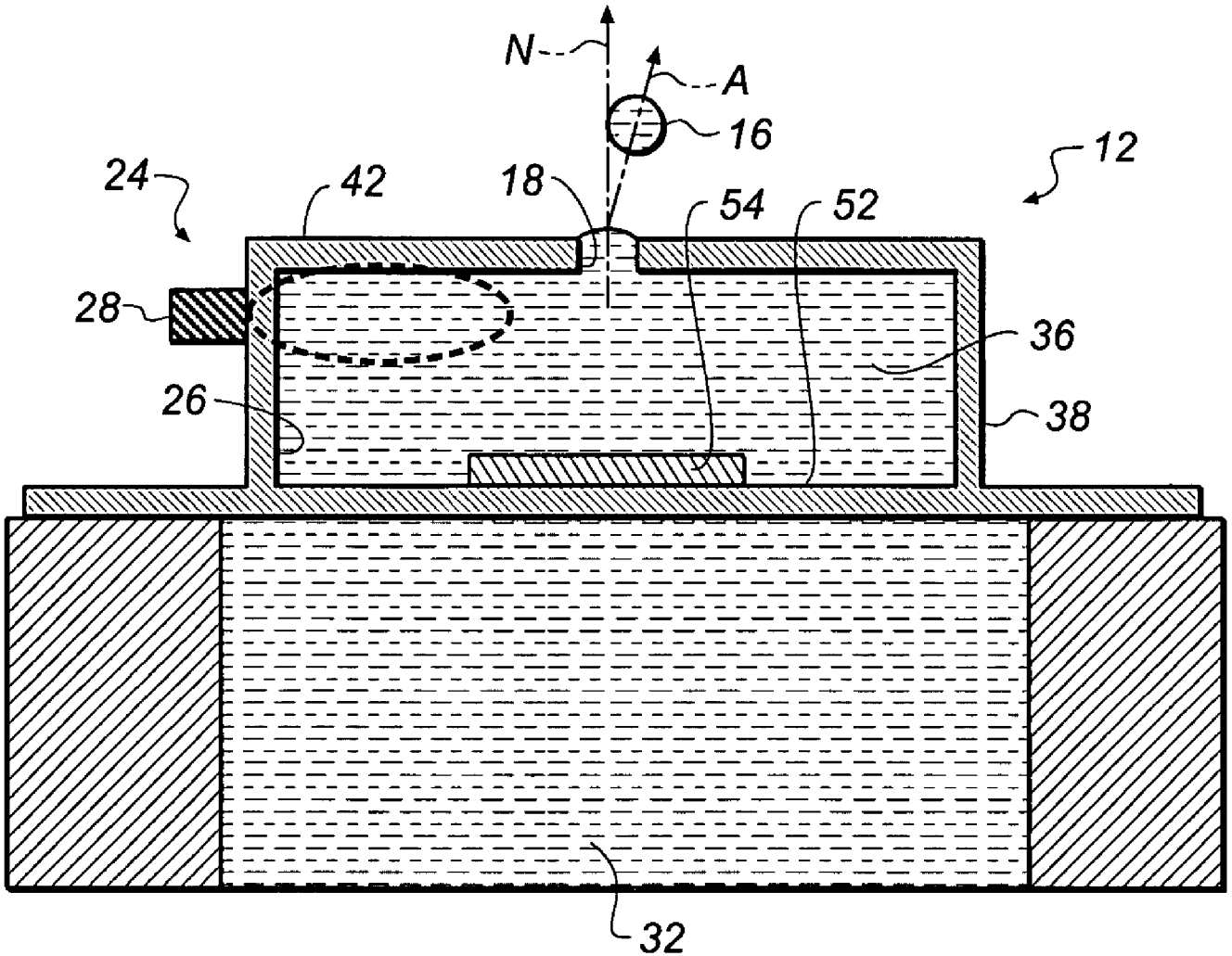
FIG. 9*a* is a side view in cross section of a print head nozzle having a heater mounted in position outside the fluid chamber.
Figure 9B:
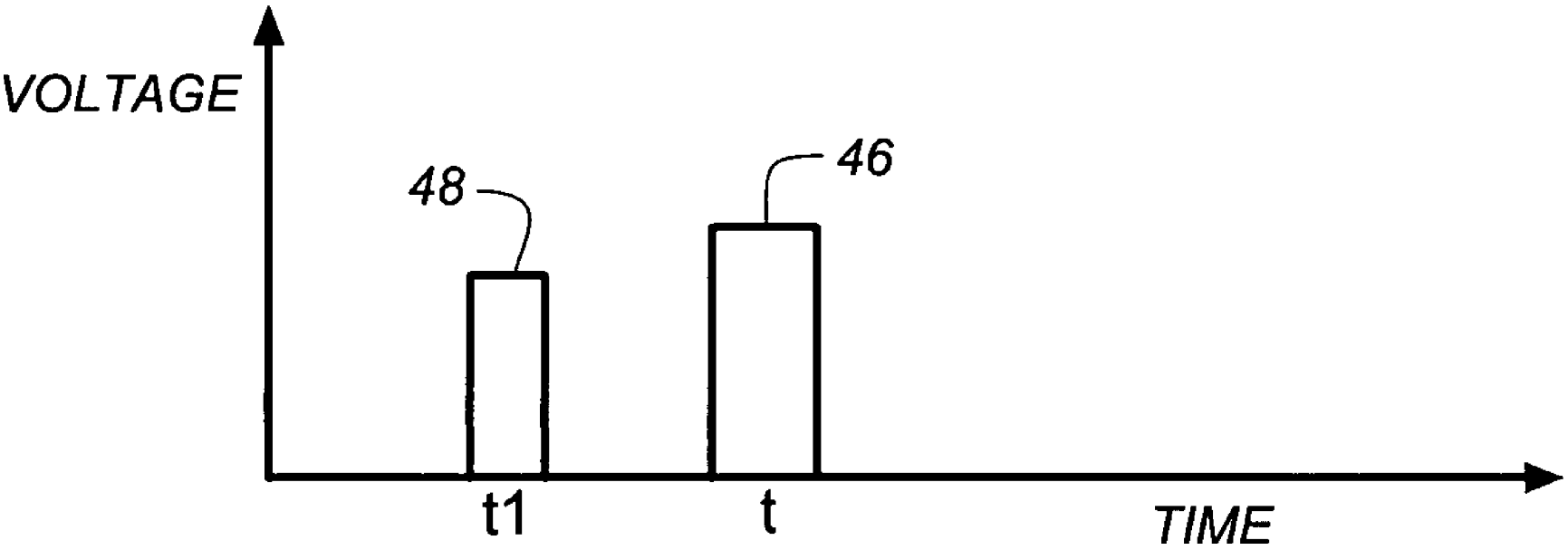
FIG. 9*b* is a graph showing the timing of an actuation signal as provided for the nozzle shown in FIG. 9*a;*

Referring to FIG. 9*a*, there is shown yet another embodiment of the present invention in which a bubble-forming heater 54, typically mounted along a chamber bottom 52 provides the drop-forming mechanism for nozzle 12. Heater 28, providing droplet steering perturbation as fluid drop steering device 24, is separate from bubble-forming heater 54. The graph of FIG. 9*b* shows the relative timing relationship of drive voltage to fluid drop steering device 24 during a perturbation pulse 48 at a time t1 and to bubble-forming heater 54 for effecting the movement shown in FIG. 9*a* during an ejection pulse 46 at time t. In this embodiment, perturbation pulse 48 corresponds to the voltage provided to heater 28. Perturbation pulse 48 (time t1) is represented as having a lower voltage level and shorter time duration than that of ejection pulse 46 (time t); however, this may or not be the case, depending on the type of fluid drop steering device 24 that is employed and on the efficiency of the respective heaters 28 and 54.

Figure 10A:
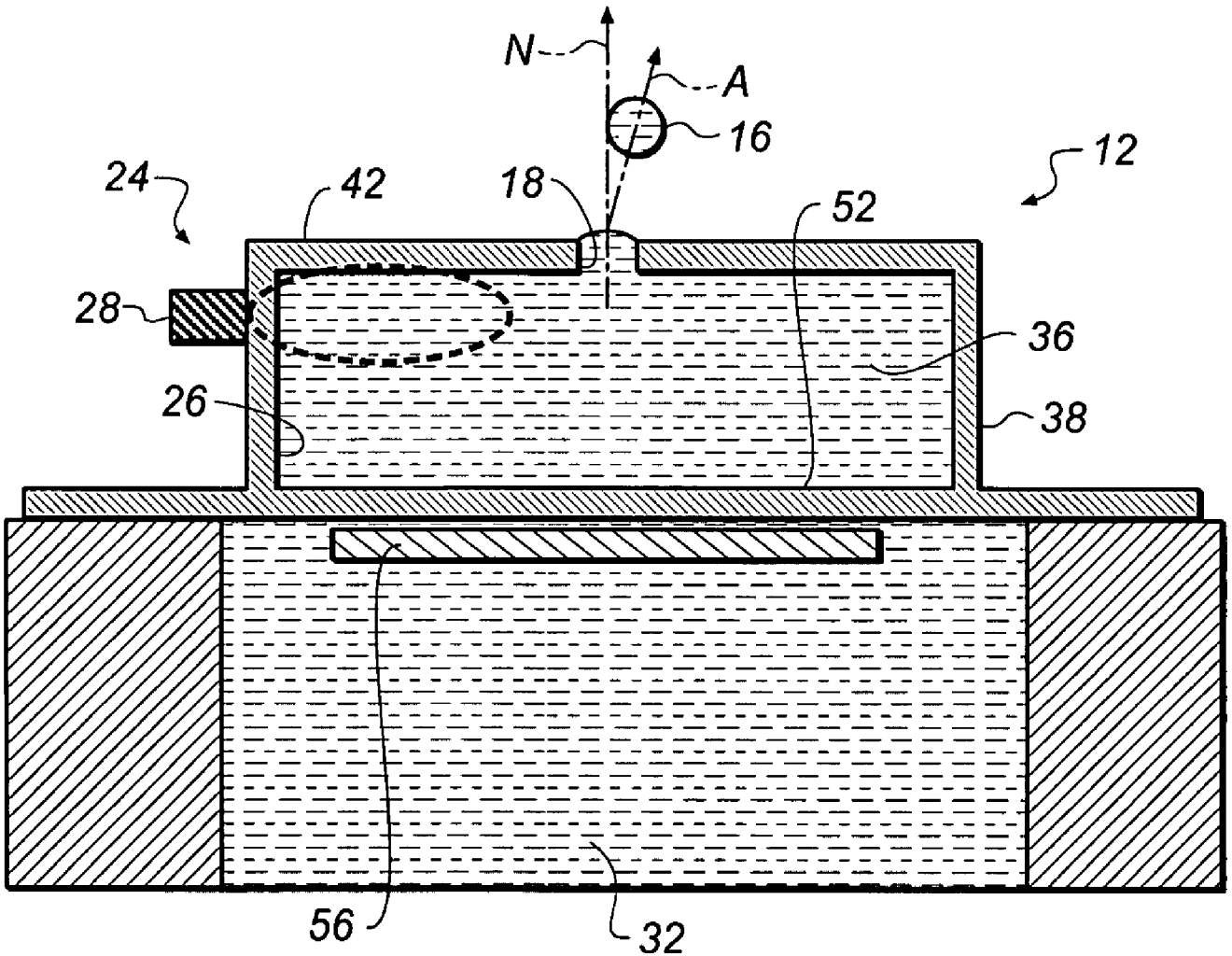
FIG. 10*a* is a side view in cross section of a print head nozzle having a heater mounted in position outside the fluid chamber using a piezoelectric actuator for droplet formation.
Figure 10B:
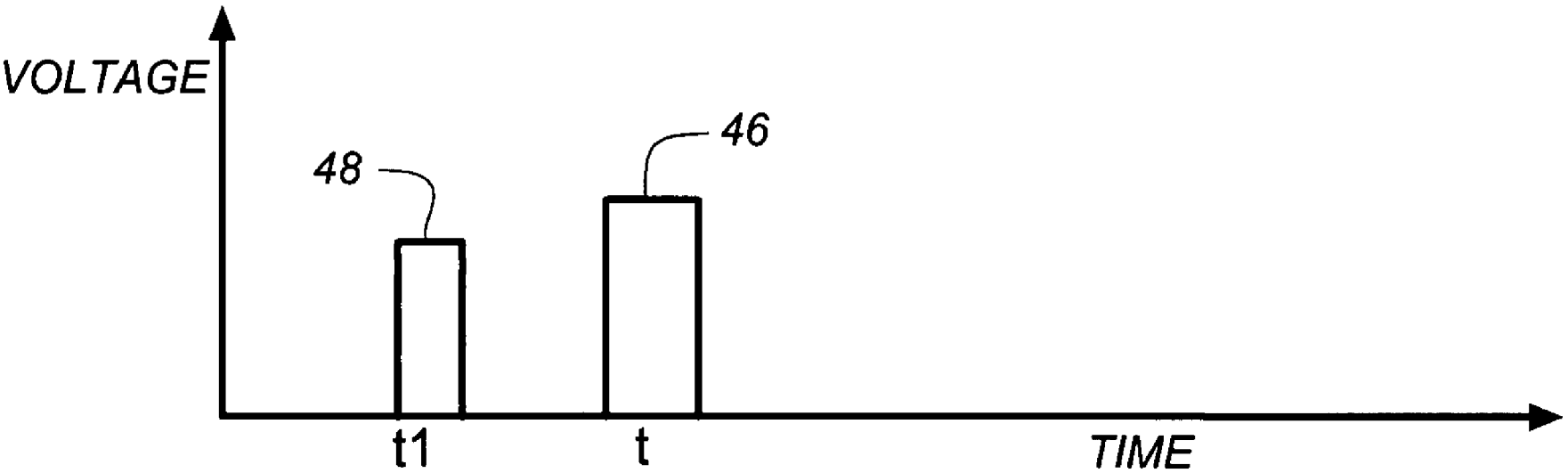
FIG. 10*b* is a graph showing the timing of an actuation signal as provided for the nozzle shown in FIG. 10*a;*

Referring to FIG. 10*a*, there is shown yet another embodiment of the present invention in which piezoelectric actuator, typically mounted along or near chamber bottom 52, provides the drop-forming mechanism for nozzle 12. As with the embodiment of FIG. 9*a*, heater 28 provides droplet steering perturbation as fluid drop steering device 24. The graph of FIG. 10*b* shows the relative timing relationship of drive voltage to fluid drop steering device 24 during perturbation pulse 48 for time t1 and to piezoelectric actuator 56 in order to effect the movement shown in FIG. 10*a* during an ejection pulse 46 for a time t. In this embodiment, perturbation pulse 48 corresponds to the voltage provided to heater 28. Perturbation pulse 48 (time t1) is represented as having a lower voltage level and shorter time duration than that of ejection pulse 46 (time t); however, this may or not be the case, depending on the type of fluid drop steering device 24 that is employed and on the efficiency of respective heater 28 and piezoelectric actuator 56.

Figure 11:
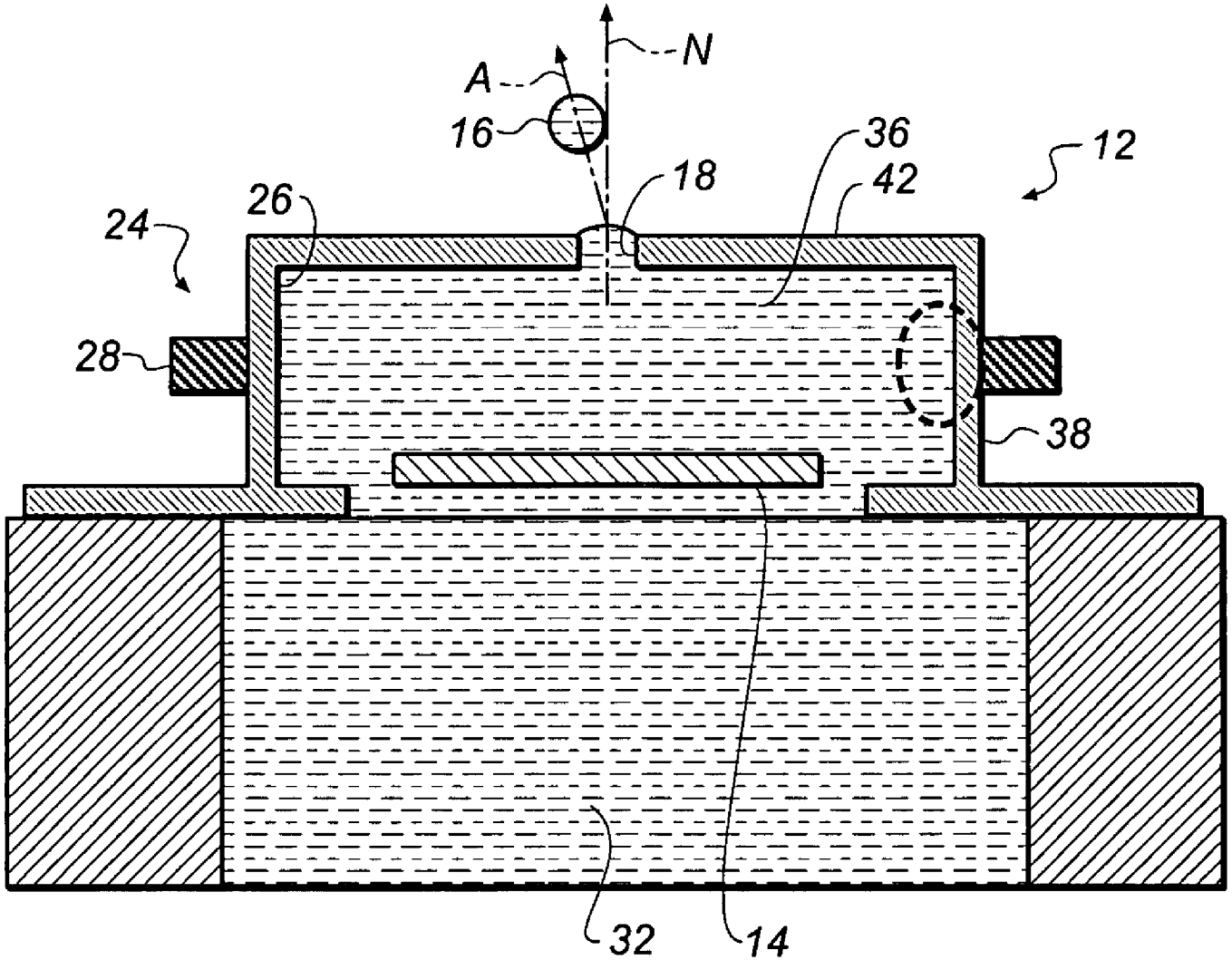
FIG. 11 is a side view in cross section of a print head nozzle having multiple steering heaters mounted along the side walls of a fluid chamber.
Figure 12:
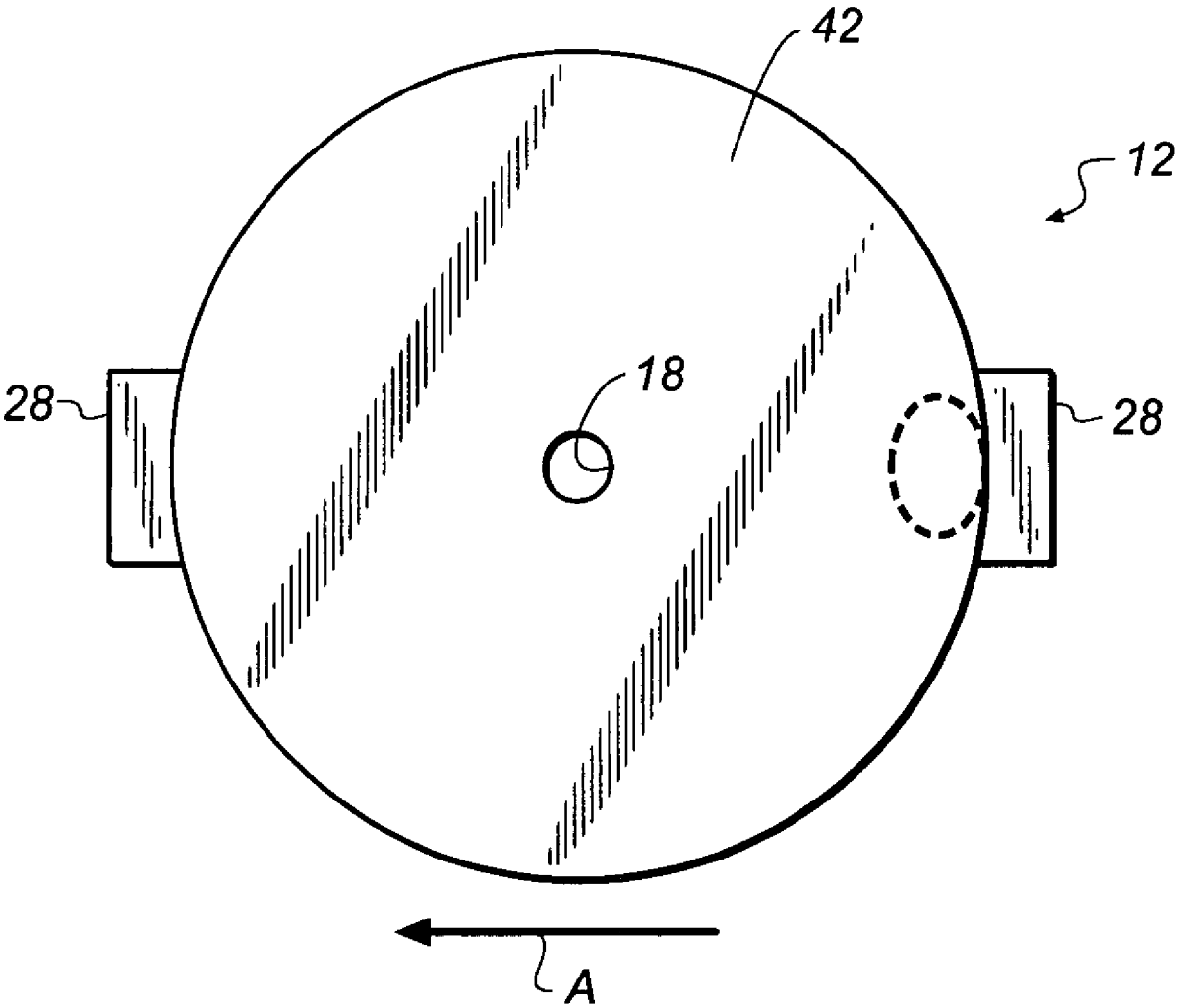
FIG. 12 is a top view showing one arrangement of a print head nozzle having multiple steering heaters; and, FIG. 13 is a top view showing an alternate arrangement of a print head nozzle having multiple steering heaters.
Figure 13:
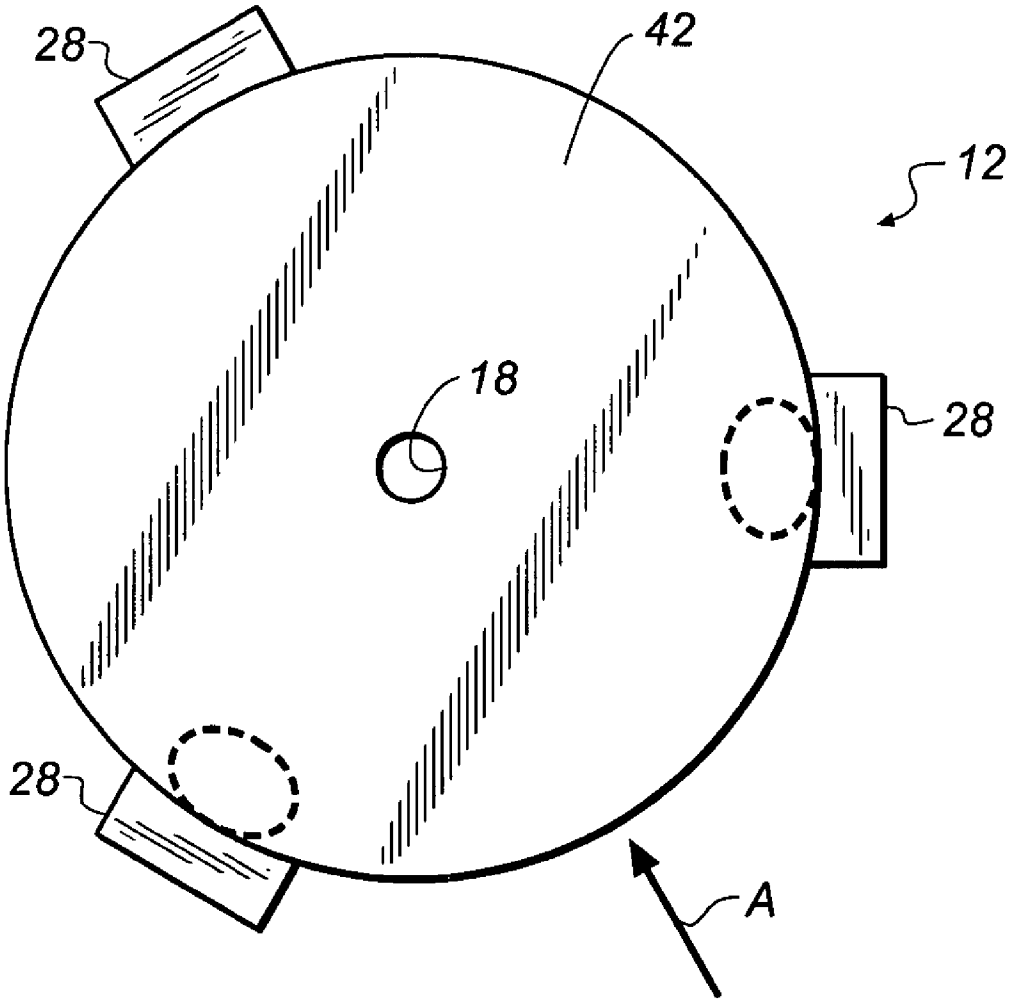

In the embodiment shown in the side view of FIG. 11 and top views of FIGS. 12 and 13, multiple heaters 28 are provided for perturbing the fluid within fluid chamber 36. Using this arrangement, varying amounts of heat energy could be applied at one or more heaters 28 in order to have specific impact on trajectory A. The top view of FIG. 12 shows how asymmetric application of heat energy at one heater 28 may affect trajectory A for nozzle 18 in an arrangement using two heaters 28. The top view of FIG. 13 shows asymmetric application of heat energy at multiple heaters 28.

While the embodiments shown in FIGS. 3*a*-13 are for drop-on-demand print heads, similar techniques could be applied for continuous flow print heads. Heat or other perturbing energy applied asymmetrically within fluid chamber 36 has some affect on fluid characteristics such as local viscosity, with the potential to alter trajectory angles for ejected droplets 16, whether a drop-on-demand or continuous flow device is used. Fluid drop steering device 24 could be a heater of some type, as is described with reference to FIGS. 3*a*-13; however, other devices that provide local perturbance of the fluid could be used in similar fashion, including paddles, valves, or other devices that cause fluid movement themselves prior to drop ejection or cause modification of the fluid movement subsequently induced by drop ejection. Such modifications may arise either from alteration of fluid properties such as viscosity or from alteration of chamber geometry, as would be caused by opening or closing a valve in the chamber or from movement of a paddle from a first to a second position in the chamber. Alteration of chamber geometry alters fluid flow paths which alters droplet trajectories, as is well known in the art of fluid dynamics.

The apparatus and method of the present invention does not use the same mechanism for both droplet formation/ejection and for droplet steering. Instead, the fluid drop steering device of the present invention is distinct from the fluid drop forming mechanism, allowing subtle changes to be effected with respect to ink jet droplet positioning without changing the overall control sequence and timing required for droplet ejection. By applying only a slight perturbing energy within each fluid chamber 36, the present invention also allows fine-tuning of the droplet 16 trajectory.

The invention has been described in detail with particular reference to certain preferred embodiments thereof, but it will be understood that variations and modifications can be effected within the scope of the invention.

PARTS LIST

10. Imaging apparatus
12. Nozzle
14. Actuator
16. Droplet
18. Orifice
20. Heater
22. Electrode
24. Fluid drop steering device
25. Mechanical actuator
26. Side wall
28. Heater
30. Print head
32. Fluid reservoir
34. Meniscus
36. Fluid chamber
38. Chamber wall
40. Receiver
42. Nozzle plate
44. Insulator
46. Ejection pulse
48. Perturbation pulse
50. Image source
52. Chamber bottom
54. Bubble-forming heater
56. Piezoelectric actuator
60. Image processor
90. Drop steering controller
95. Platen
100. Transport roller
110. Transport control system
120. Logic controller
130. Ink pressure regulator
140. Ink reservoir
150. Conduit
160. Drop forming controller

What is claimed is:

1. A printhead comprising:

a fluid chamber having an orifice;

a fluid drop forming mechanism associated with the fluid chamber to apply to fluid present in the fluid chamber drop forming energy which is sufficient to cause a fluid drop to be ejected from the orifice; and a fluid drop steering device associated with the fluid chamber when the fluid is within the fluid chamber to apply to fluid inside of the fluid chamber a fluid perturbing energy which is insufficient to cause drop formation to fluid present in the fluid chamber and which provides local perturbance of such fluid that changes the velocity of fluid flow during drop ejection to alter a drop path of the fluid drop from the orifice to an angle away from normal to the orifice, the fluid drop steering device being distinct from the fluid drop forming mechanism.

2. The printhead according to claim 1, wherein the fluid drop steering device is a mechanical actuator located in the fluid chamber.

3. The printhead according to claim 2, wherein the mechanical actuator is a paddle.

4. The printhead according to claim 3, the fluid chamber having a side wall, wherein the paddle is located adjacent to the side wall of the fluid chamber.

5. The printhead according to claim 2, wherein the mechanical actuator is a valve.

6. The printhead according to claim 1, wherein the fluid drop steering device is a heater operatively associated with the fluid chamber so that the fluid perturbing energy is heat energy, the heat energy raising fluid temperature to provide a change in fluid viscosity that changes the velocity of fluid flow during drop ejection to alter the drop path of the fluid drop from the orifice to the angle away from normal to the orifice.

7. The printhead according to claim 6, the fluid chamber having a conductive side wall, wherein the heater is formed as a portion of the conductive side wall.

8. The printhead according to claim 6, wherein the heater is in electrical communication with electrical contacts located outside of the fluid chamber.

9. The printhead according to claim 6, wherein the heater is located in the fluid chamber.

10. The printhead according to claim 9, the fluid chamber having a side wall, wherein the heater is located adjacent to the side wall.

11. The printhead according to claim 9, wherein the heater is coupled to the fluid drop forming mechanism.

12. The printhead according to claim 9, wherein the orifice is located in a nozzle plate, and wherein the heater is located adjacent to the nozzle plate.

13. The printhead according to claim 6, wherein the heater is located outside the fluid chamber.

14. The printhead according to claim 13, the fluid chamber having a side wall, wherein the heater is located adjacent to the side wall.

15. The printhead according to claim 1, the printhead further comprising:

a fluid reservoir in fluid communication with the fluid chamber, wherein the fluid drop steering device is a heater operatively associated with the fluid reservoir.

16. The printhead according to claim 1, wherein the fluid drop steering device is a plurality of electrodes operatively associated with the fluid chamber.

17. The printhead according to claim 1, wherein the fluid drop forming mechanism comprises a heater operatively associated with the fluid chamber.

18. The printhead according to claim 1, wherein the fluid drop forming mechanism comprises a piezoelectric actuator operatively associated with the fluid chamber.

19. The printhead according to claim 1, wherein the fluid drop forming mechanism comprises an actuator movable between a plurality of positions.

20. The printhead according to claim 1, wherein the fluid drop forming mechanism is a drop on demand drop forming mechanism.

21. The printhead according to claim 1, wherein the fluid drop forming mechanism is a continuous drop forming mechanism.

22. The printhead according to claim 1, wherein the fluid drop steering device comprises a plurality of steering devices positioned about the orifice of the fluid chamber.

23. The printhead according to claim 1, wherein the fluid drop steering device comprises a mechanical actuator movable between a plurality of positions and operatively associated with the fluid chamber.

24. The printhead according to claim 1, the fluid chamber having a side wall, wherein the fluid drop steering device comprises a portion of the side wall of the fluid chamber.

25. The printhead according to claim 1, wherein the fluid drop steering device is located within the fluid chamber.

26. The printhead according to claim 1, wherein the fluid drop steering device is located removed from the fluid chamber.

27. The printhead according to claim 1, wherein the fluid drop steering device is operable to be able to apply the energy to fluid inside he fluid chamber including applying the energy optionally.

* * * * *